US006913562B2

(12) United States Patent
Chen

(10) Patent No.: US 6,913,562 B2
(45) Date of Patent: Jul. 5, 2005

(54) FOLDING COLLAPSIBLE TREADMILL HAVING POSITIONING APPARATUS

(76) Inventor: Chang Shu Chen, 7F-7, No. 400 , Huan Pei Rd., Chung Li City, Tao Yuan Hsien (TW)

( * ) Notice: Subject to any disclaimer, the term of this patent is extended or adjusted under 35 U.S.C. 154(b) by 440 days.

(21) Appl. No.: 10/145,706

(22) Filed: May 16, 2002

(65) Prior Publication Data

US 2003/0216226 A1 Nov. 20, 2003

(51) Int. Cl.[7] ..... A63B 22/02
(52) U.S. Cl. ..... 482/54
(58) Field of Search ..... 482/54

(56) References Cited

U.S. PATENT DOCUMENTS 5,904,638 A * 5/1999 Habing et al. ..... 482/57
6,126,576 A * 10/2000 Wang ..... 482/54
6,261,209 B1 * 7/2001 Coody ..... 482/54
6,419,612 B1 * 7/2002 Yu ..... 482/54
6,494,814 B1 * 12/2002 Wang et al. ..... 482/54
6,695,751 B1 * 2/2004 Hsu ..... 482/54

* cited by examiner

*Primary Examiner*—Stephen R. Crow
(74) *Attorney, Agent, or Firm*—Bacon & Thomas

(57) ABSTRACT

A folding collapsible treadmill includes base, a treadmill platform, the treadmill having a front side pivoted the base for enabling the treadmill platform to be turned relative to the base between a horizontal operative position and a vertical non-operative position, and a positioning apparatus installed adapted for locking the treadmill platform in the vertical non-operative position, the positioning apparatus including a stop member mounted in the treadmill platform, and a lever pivoted to one side of the treadmill platform and adapted for turning the movable stop member between a first position where the stop member is forced into engagement with the base to lock the treadmill platform in the vertical non-operative position, and a second position where the stop member is disengaged from the base for enabling the treadmill platform to be turned between the vertical non-operative position and the horizontal operative position.

6 Claims, 5 Drawing Sheets

FOLDING COLLAPSIBLE TREADMILL HAVING POSITIONING APPARATUS

BACKGROUND OF THE INVENTION

1. Field of the Invention

The present invention relates to a folding collapsible treadmill and, more specifically, to a folding collapsible treadmill positioning apparatus.

2. Description of the Related Art

A conventional folding collapsible treadmill is generally comprised of a base adapted for supporting on the floor, a handrail fixedly mounted on and upwardly extended from the base, and a treadmill platform pivoted to the base and turned relative to the base between a horizontal position, namely, the operative position, and a vertical position, namely, the non-operative position. When not in use, the treadmill platform is turned to the non-operative position and closely attached to the handrail. In order to prevent falling of the treadmill platform from the non-operative position to the operative position when not in use, support means may be provided between the treadmill platform and the base for supporting the treadmill platform in the non-operative position. Alternatively, a snap fastener may be installed in the handrail and the treadmill platform for locking the treadmill platform in the non-operative position. It is practical to provide a folding collapsible treadmill with a simple structure of safety means to prevent the treadmill platform from falling down when received in the non-operative position.

SUMMARY OF THE INVENTION

It is one object of the present invention to provide a folding collapsible treadmill having a positioning apparatus, which positively locks the treadmill when the treadmill received in the non-operative position.

It is another object of the present invention to provide a folding collapsible treadmill having a positioning apparatus, which uses spring latch means to lock the treadmill platform in position when the treadmill received in the non-operative position.

It is still another object of the present invention to provide a folding collapsible treadmill having a positioning apparatus, which has a simple structure.

It is still another object of the present invention to provide a folding collapsible treadmill having a positioning apparatus, which is easy to operate.

To achieve these objects of the present invention, the folding collapsible treadmill comprises a base, a treadmill platform, the treadmill having a front side pivoted the base for enabling the treadmill platform to be turned relative to the base between a horizontal operative position and a vertical non-operative position, and a positioning apparatus installed adapted for locking the treadmill platform in the vertical non-operative position, the positioning apparatus including a stop member mounted in the treadmill platform, and a lever pivoted to one side of the treadmill platform and adapted for turning the movable stop member between a first position where the stop member is forced into engagement with the base to lock the treadmill platform in the vertical non-operative position, and a second position where the stop member is disengaged from the base for enabling the treadmill platform to be turned between the vertical non-operative position and the horizontal operative position.

DETAILED DESCRIPTION OF THE PREFERRED EMBODIMENT

Figure 1:
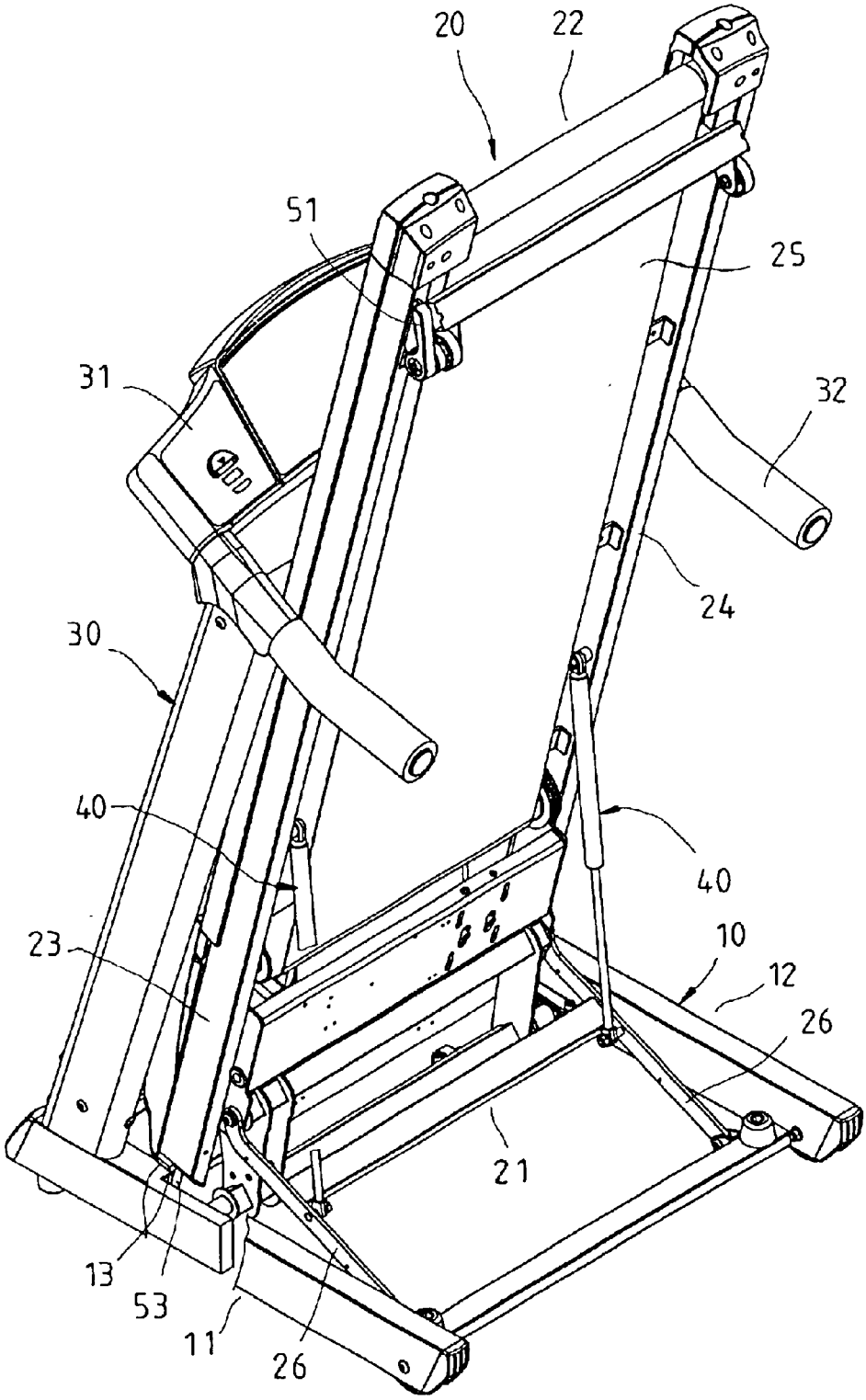
FIG. 1 is a perspective view of a folding collapsible treadmill constructed according to the present invention.
Figure 2:
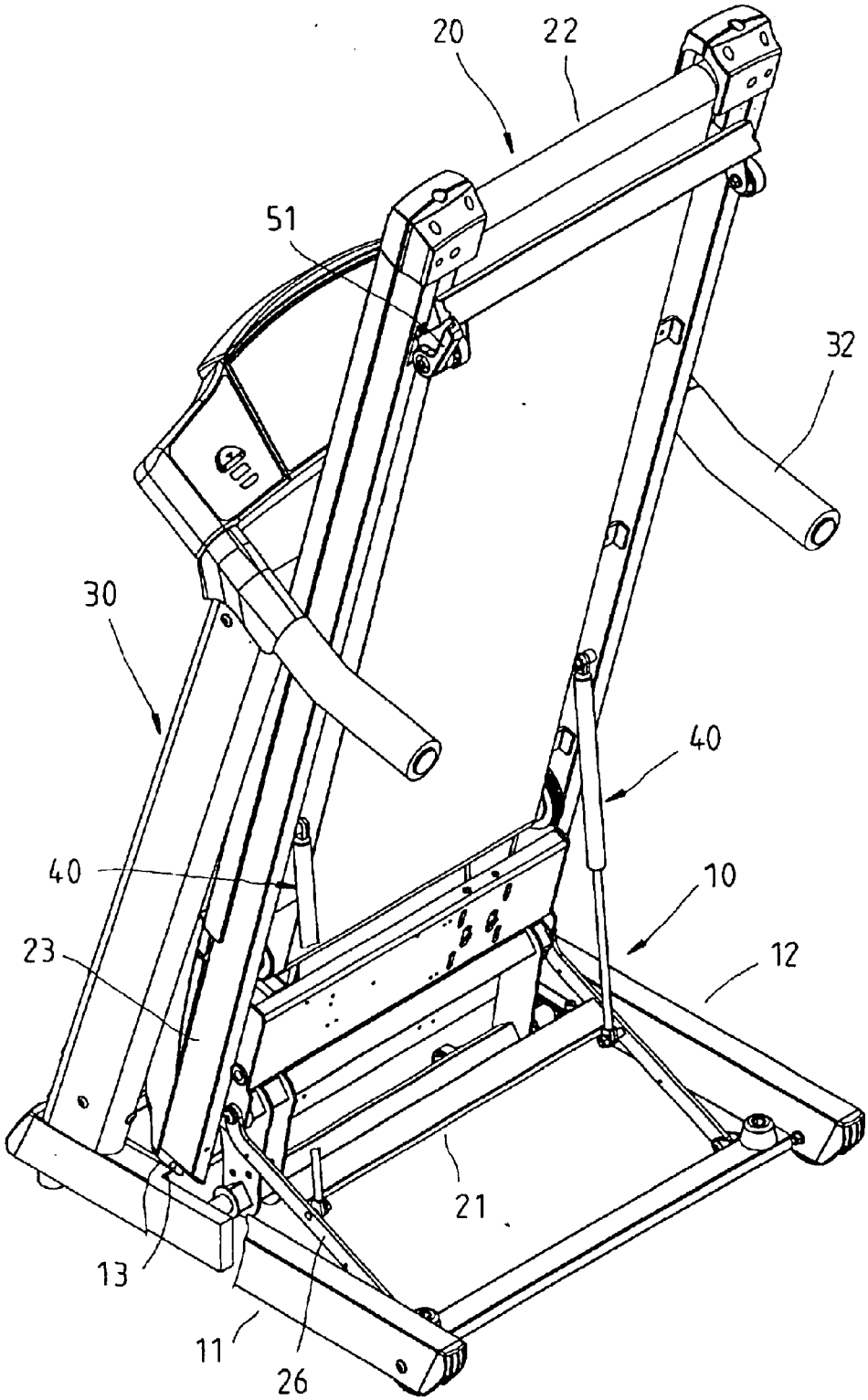
FIG. 2 is similar to FIG. 1 but showing the stop member disengaged from the stop portion of the left sidebar of the base.

Referring to FIGS. 1 and 2, a folding collapsible treadmill having a positioning apparatus is shown comprised of a base 10, a treadmill platform 20, a handrail 30, an instrument 31 mounted on the handrail 30, two braces 40, and a positioning apparatus 50.

The base 10 comprises a left sidebar 11 and a right sidebar 12 arranged in parallel. The left sidebar 11 has a step forming a stop portion 13. The handrail 30 is fixedly fastened to and upwardly extended from the front side of the base 10, having two backwardly extended handgrips 32 for the holding of the user's hands.

The treadmill platform 20 is a rectangular device formed of cylindrical members, having a front side 21, a rear side 22, a left frame tube 23, a right frame tube 24, a crawler track 25 provided between the front side 21 and the rear side 22, a motor (not shown) installed in the front side 21 and adapted for turning the crawler track 25, two links 26 bilaterally connected between the front side 21 and the base 10 for enabling the treadmill platform 20 to be turned relative to the base 10 between a vertical position and a horizontal position, i.e., the non-operative position (see FIG. 1) and the operative position. Because the motor, the crawler track 25 and the links 26 are commonly seen in conventional folding collapsible treadmills, no further detailed description in this regard is necessary.

Figure 3:
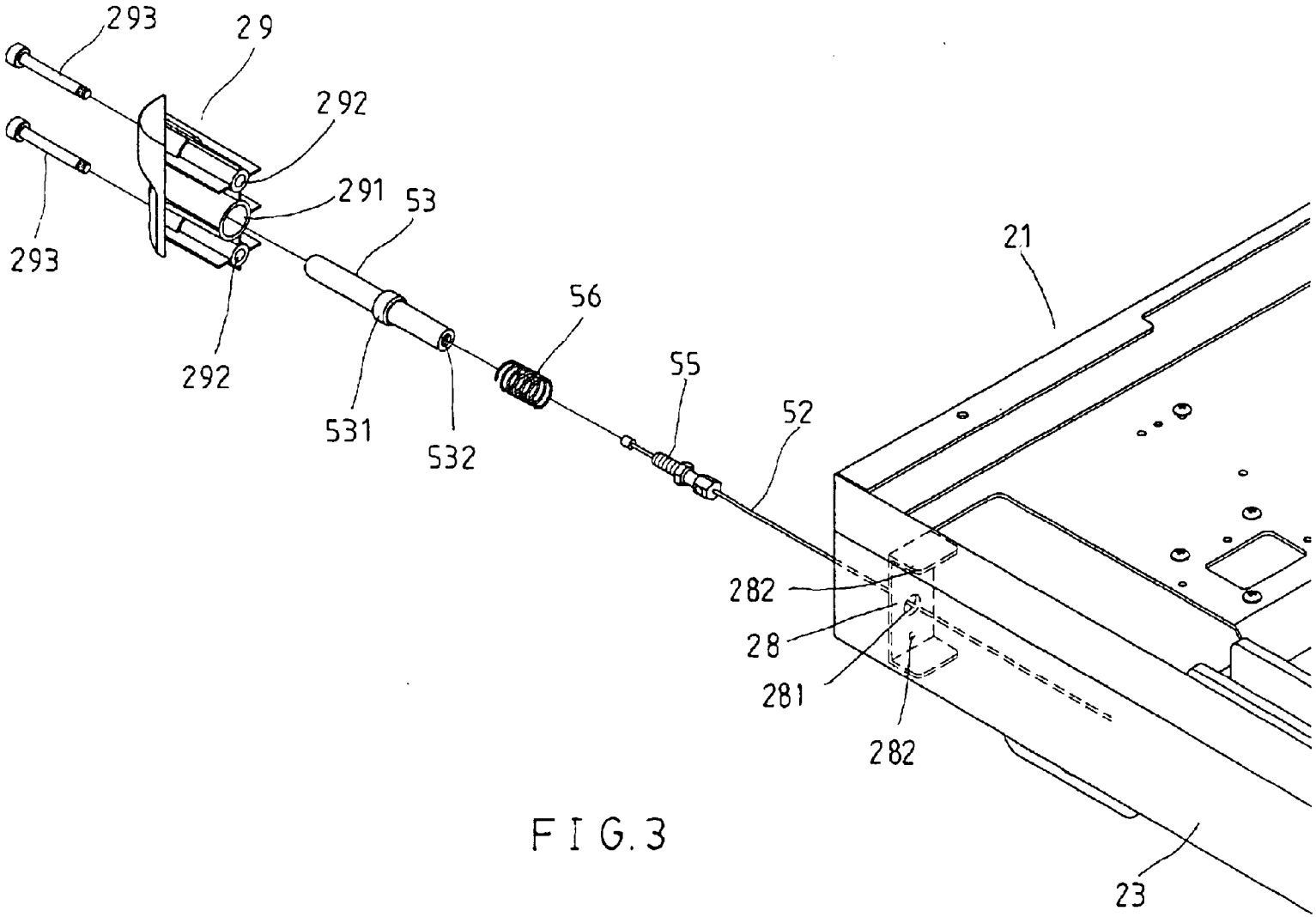
FIG. 3 is an exploded view of a part of the positioning apparatus according to the present invention, showing the relationship between the stop member and the related parts of the treadmill platform.
Figure 4:
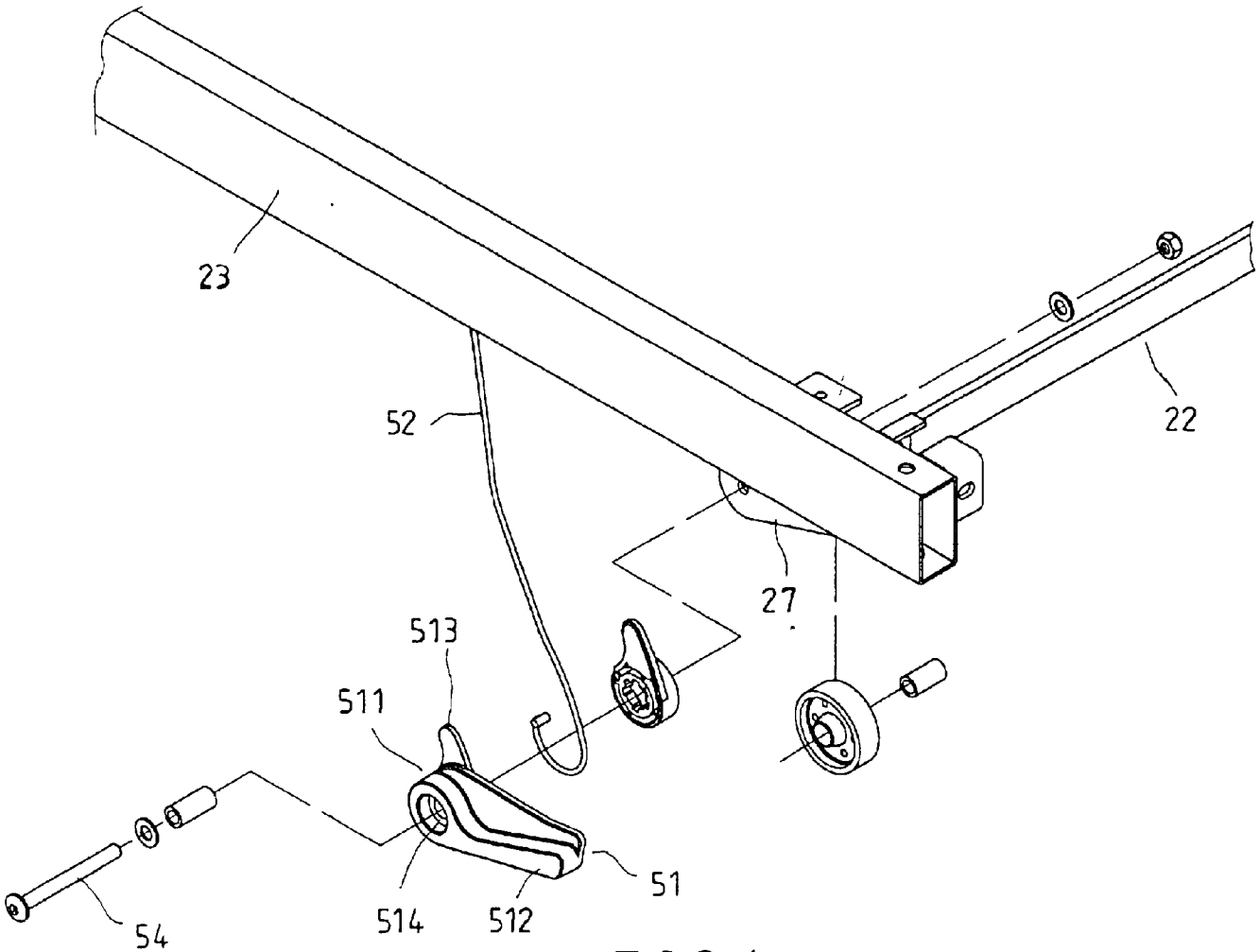
FIG. 4 is an exploded view of a part of the positioning apparatus according to the present invention, showing the relationship between the lever and the related parts of the treadmill platform.

Referring to FIGS. 3 and 4, the left frame tube 23 comprises a bottom lug 27 extended from the bottom sidewall thereof adjacent to the rear side 22, a stop plate 28 fixedly mounted on the inside near the front side 21, and a guide block 29 inserted into the front end thereof. The locating plate 28 has a center through hole 281, and two screw holes 282 equally spaced from the center through hole 281 at different elevations. The guide block 29 has an elongated center axle hole 291 and two mounting holes 292 respectively disposed corresponding to the center through hole 281 and screw holes 282 of the locating plate 28. Two screw bolts 293 are respectively mounted in the mounting holes 292 and threaded into the screw holes 282 to fixedly secure the guide block 29 to the locating plate 28.

Referring to FIGS. 1 and 2 again, the braces 40 are respectively formed of a respective retractable bar, each having one end pivoted to the left frame tube 23 or right frame tube 24 of the treadmill platform 20 and the other end pivoted to one link 26. The braces 40 are extended out when turning the treadmill platform 20 upwards from the operative position to the non-operative position. When the treadmill platform 20 set in the non-operative position, the braces 40 stop the treadmill platform 20 from falling down. The retractable structure of the braces 40 is of the known art and not within the scope of the claims of the present invention, no further detailed description is necessary.

Figure 5:
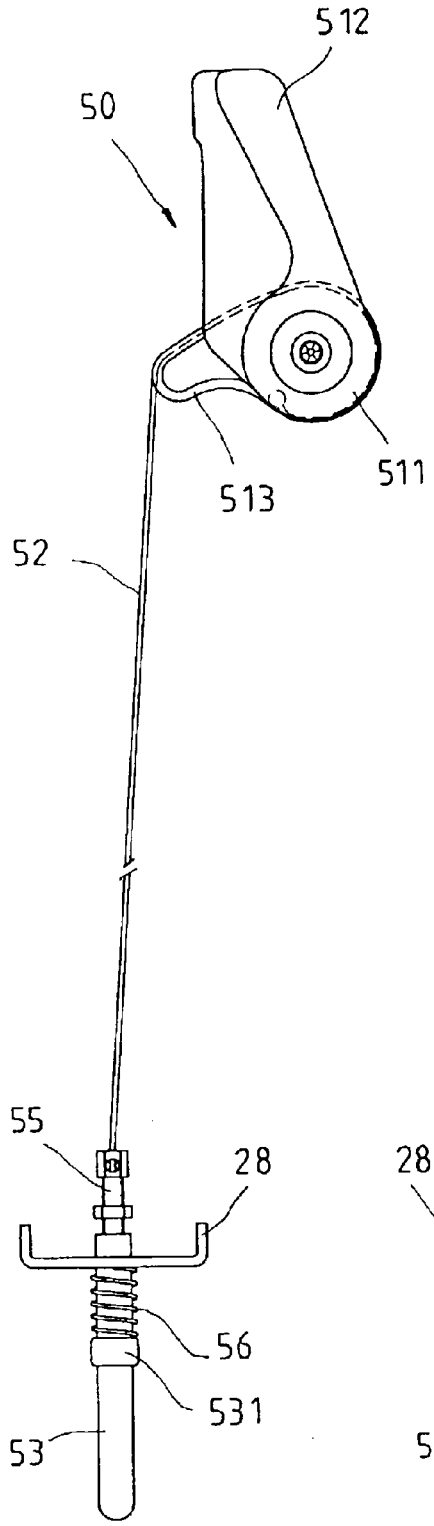
FIG. 5 illustrates one status of the positioning apparatus where the spring supports the stop member in the first position.
Figure 6:
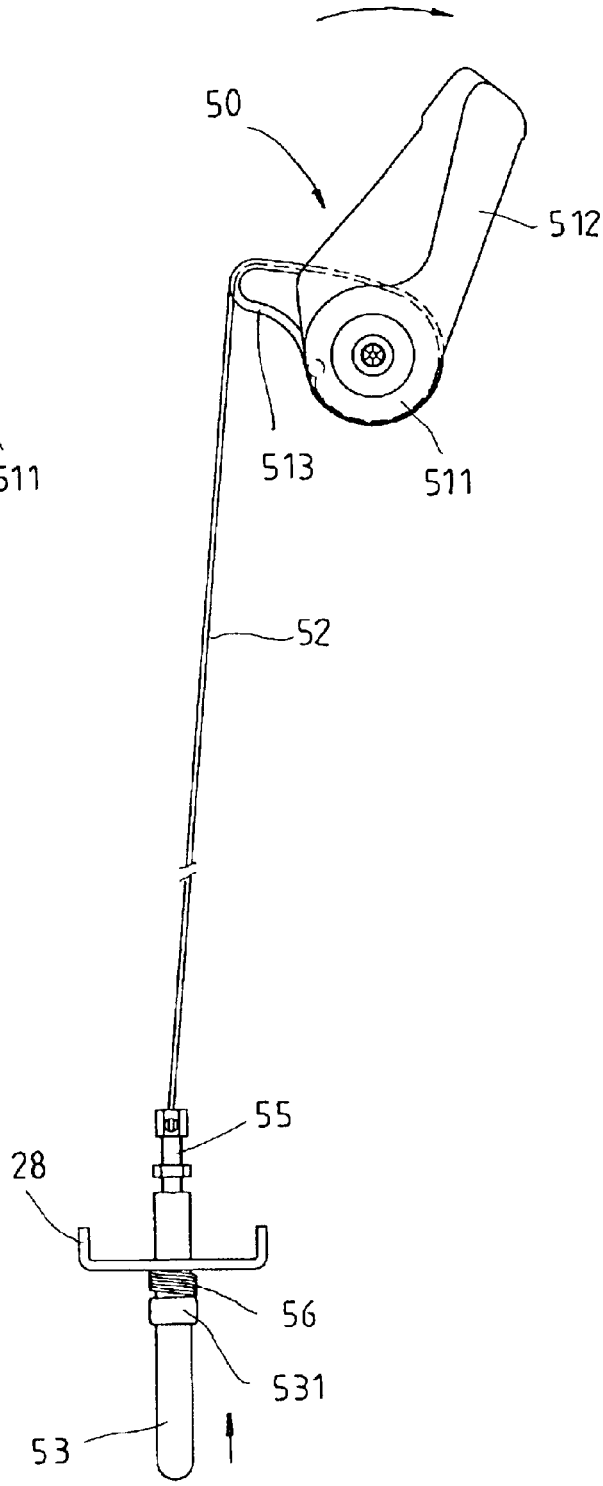
FIG. 6 is a schematic drawing of the positioning apparatus showing the lever operated, the stop member moved to the second position.

Referring to FIGS. 5 and 6 and FIGS. 3 and 4 again, the positioning apparatus 50 is installed in the left frame tube 23 of the treadmill platform 20, comprised of a lever 51, a connecting member 52, and a stop member 53. The lever 51 comprises a circular base 511, a handle 512 extended from the circular base 511 in one direction, and a lug 513 extended from the circular base 511 in another direction. The circular base 511 has a center pivot hole 514 connected to the bottom lug 27 of the left frame tube 23 by a pivot pin 54. The connecting member 52 is a steel rope inserted through the left frame tube 23, having a first end extended over the lug 513 of the lever 51 and then fixedly connected to the circular base 511 and a second end extended through the center through hole 281 of the locating plate 28 and a hollow fastening element 55 to the outside of the front side 21 of the treadmill platform 20. The stop member 53 is a latch inserted into the elongated center axle hole 291 of the guide block 29, having a flange 531 extended around the periphery thereof on the middle and stopped outside the guide block 29 and a screw hole 532 axially extended in the rear end-thereof. The hollow fastening element 55 is threaded into the screw hole 532 of the stop member 53 to secure the second end of the connecting member 52 to the stop member 53. Further, a spring 56 is mounted on the stop member 53 and stopped between the flange 531 of the stop member 53 and the locating plate 28. When the stop member 53 does no work, the spring 56 supports the stop member 53 in a first position away from the locating plate 28 (see FIGS. 1 and 5). When turning the lever 51 in one direction, the lug 513 of the lever 51 is forced to pull the connecting member 52, and at the same time the stop member 53 is moved from the first position to a second position to compress the spring 56 against the locating plate 28 (see FIGS. 2 and 6).

The operation of the treadmill is outlined hereinafter. When the treadmill platform 30 set in the non-operative position and attached to the handrail 30, as shown in FIGS. 1 and 5, the braces 40 are set in the extended position to support the treadmill platform 30 in the non-operative position, and the stop member 53 extends out of the guide block 29 and stopped at the stepped stop portion 13 of the left sidebar 11 of the base 10, and therefore the treadmill platform 20 is positively supported in the non-operative position. When in use, as shown in FIGS. 2 and 6, turn the handle 512 of the lever 51 clockwise to pull the connecting member 52 and to further move the stop member 53 from the first position shown in FIG. 5 to the second position shown in FIG. 6. At this time, the stop member 53 is received inside the guide block 29 and disengaged from the stepped stop portion 13 of the left sidebar 11 of the base 10, enabling the user to turn the treadmill platform 20 from the non-operative position to the operative position.

In addition to the supporting effect of the braces, the positioning apparatus provides a second supporting effect to positively support the treadmill platform in the non-operative position when the treadmill received. Further, the lever of the positioning apparatus may be installed in the base for moving the stop member directly between the first position and the second position.

What the invention claimed is:

1. A folding collapsible treadmill comprising:

a base adapted for positioning on a flat surface, said base having two sidebars arranged in parallel at two sides;

a treadmill platform, said treadmill having a front side and a rear side, the front side of said treadmill platform being pivoted to a front side of said base for enabling said treadmill platform to be turned relative to said base between a horizontal operative position and a vertical non-operative position;

a positioning apparatus installed in said treadmill platform and adapted for locking said treadmill platform in said vertical non-operative position, said positioning apparatus having a movable stop member mounted in said treadmill platform, and a lever pivoted to one side of said treadmill platform and adapted for turning said movable stop member between a first position where said movable stop member is forced into engagement with a part of said base to lock said treadmill platform in said vertical non-operative position, and a second position where said movable stop member is disengaged from said base for enabling said treadmill platform to be turned relative to said base between said vertical non-operative position and said horizontal operative position; and wherein said treadmill platform comprises two frame tubes longitudinally disposed at two sides and arranged in parallel, one of said frame tubes comprising a bottom lug disposed near a rear side thereof and adapted for supporting said lever and an inside guide block fixedly disposed near a front side thereof, said guide block having an elongated axle hole adapted for guiding movement of said stop member between said first position and said second position; said stop member is a latch inserted through said axle hole of said guide member for axial movement along said axle hole between said first position and said second position.

2. The folding collapsible treadmill as claimed in claim 1, wherein said positioning apparatus further comprises a connecting member connected between said stop member and said lever.

3. The folding collapsible treadmill as claimed in claim 2, wherein said lever is pivoted to said treadmill platform near a rear side of said treadmill platform and turned to pull said connecting member and to further move said stop member from said first position to said second position.

4. The folding collapsible treadmill as claimed in claim 3, wherein said lever comprises a circular base and a handle extended from said circular base; said connecting member is a steel rope having one end wound round said circular base of said lever and fixedly connected to a part of said circular base and an opposite end connected to a rear end of said stop member.

5. The folding collapsible treadmill as claimed in claim 1, wherein said base comprises a stepped stop portion formed in one sidebar thereof and adapted for stopping said stop member in said first position.

6. The folding collapsible treadmill as claimed in claim 1, wherein the frame tube of said treadmill platform in which said lever is installed comprises a locating plate fixedly provided on the inside near the front side thereof, said locating plate having a center through hole and two screw holes equally spaced from said center through hole at two opposite sides; said guide block has two mounting holes respectively fixedly fastened to the screw holes by a respective screw bolt; said stop member is mounted with a spring, having a flange extended around the periphery and stopped at one side of said guide block outside said axle hole, said spring being mounted on said stop member between the flange of said stop member and said locating plate to support said stop member in said second position.

* * * * *